US007175130B2

(12) United States Patent
Dubois et al.

(10) Patent No.: US 7,175,130 B2
(45) Date of Patent: Feb. 13, 2007

(54) MISSILE STEERING USING LASER SCATTERING BY ATMOSPHERE

(75) Inventors: Jacques Dubois, Neufchatel (CA); Jean Fortin, St-Nicolas (CA); Pierre Mathieu, Cap Rouge (CA)

(73) Assignee: Her Majesty the Queen in right of Canada, as represented by the Minister of National Defence of Her Majesty's Canadian Government, Ottawa (CA)

( * ) Notice: Subject to any disclaimer, the term of this patent is extended or adjusted under 35 U.S.C. 154(b) by 0 days.

(21) Appl. No.: 10/933,528

(22) Filed: Sep. 3, 2004

(65) Prior Publication Data

US 2006/0049300 A1 Mar. 9, 2006

(51) Int. Cl.
*F41G 7/26* (2006.01)
*F41G 7/24* (2006.01)
*F41G 7/00* (2006.01)

(52) U.S. Cl. ..... 244/3.13; 244/3.1; 244/3.11

(58) Field of Classification Search ..... 244/3.1–3.3
See application file for complete search history.

(56) References Cited

U.S. PATENT DOCUMENTS 3,363,858 A * 1/1968 Dobbins et al. ..... 244/3.14
3,513,315 A * 5/1970 Sundstrom et al. ..... 244/3.13
3,631,485 A * 12/1971 Beazell, Jr. ..... 244/3.13
3,677,500 A * 7/1972 Brown et al. ..... 244/3.13
4,020,339 A * 4/1977 Gustafson ..... 244/3.13
4,174,818 A * 11/1979 Glenn ..... 244/3.13
4,195,799 A * 4/1980 Sogo et al. ..... 244/3.13
4,216,472 A * 8/1980 Albanese ..... 244/3.14
4,234,141 A 11/1980 Miller, Jr. et al.
4,256,275 A * 3/1981 Flick et al. ..... 244/3.19
4,330,099 A * 5/1982 Sogo et al. ..... 244/3.13
4,634,271 A * 1/1987 Jano et al. ..... 244/3.13
H299 H 7/1987 Miller, Jr.
4,768,736 A * 9/1988 Morten et al. ..... 244/3.11
5,388,783 A * 2/1995 Lynn ..... 244/3.14
5,647,559 A * 7/1997 Romer et al. ..... 244/3.13
6,138,944 A * 10/2000 McCowan et al. ..... 244/3.13
6,568,627 B1 * 5/2003 Jones et al. ..... 244/3.13

FOREIGN PATENT DOCUMENTS

JP 2000039296 2/2000

* cited by examiner

*Primary Examiner*—Bernarr E. Gregory
(74) *Attorney, Agent, or Firm*—Stites & Harbison PLLC; Ross F. Hunt, Jr.

(57) ABSTRACT

A guidance system for a missile with a laser beam source located at a distance from the missile generating a modulated laser beam that is directed towards the missile. A group of backward looking sensors on the body of the missile detect any radiation scattered from the laser beam along with a group of forward looking sensors located on the missile. Both groups look at an angle to the missile's longitudinal axis. Signals from the sensors are applied to processing electronics in the missile that determine the phase shift in signals derived from when a backward looking sensor detects scattered radiation from a laser beam and a forward looking sensor detects scattered radiation from that beam. The processing electronics can then accurately determine the distance between the missile and the beam from the phase shift and correct the missile's trajectory to maintain its position with respect to the beam.

14 Claims, 5 Drawing Sheets

MISSILE STEERING USING LASER SCATTERING BY ATMOSPHERE

FIELD OF THE INVENTION

The present invention relates to a missile guidance system where sensors on the missile detect light scattered from a laser beam, signals from the sensors being applied to processing electronics that determines the distance the missile is from the beam and then provides guidance signals to the missile's guidance system to maintain the missile's trajectory at a predetermined position with respect to the laser beam.

BACKGROUND OF THE INVENTION

Precision guidance for missiles is a subject of high interest for all military organizations throughout the world. The required precision has high costs due, in great part, to the complexity of the guidance techniques generally used. Radar, RF, GPS, TV, IR or lasers are examples of technologies that have been used to meet the guidance precision requirements. The majority of the present approaches are based on terminal homing seekers. The problem with these approaches is the high costs associated with seeker components such as gimbals, domes, high performance electronics and software. Other techniques make use of a human in the loop to reduce the complexity and costs of the components installed aboard a missile. In these techniques, a human operator provides assistance to a missile's guidance system by correcting its trajectory through a data link such that a satisfactory trajectory of the missile to the target is achieved. This approach substantially reduces the costs of the guidance system but the precision is directly proportional to the operator's skill and this can be highly variable.

Existing guidance systems for missiles may use a laser designator to provide guidance signals to the missile and these generally employ either a beam riding method or a semi-active terminal seeking method. In a semi-active terminal seeker guidance method, a sensor on board the missile detects laser energy that is reflected from a target being designated by a laser designator. Signals from the sensor are processed and outputs missile-to-target line-of-sight angles or angle rates to a guidance processor in the missile that calculates guidance commands to guide the missile to a target. In beam rider guidance systems, a missile flies inside a laser beam or beside laser beams so that guidance information can be determined from a laser scan pattern determined by one or more rearward looking detectors mounted on the missile. The scan pattern information is used by a processor on board the missile to calculate the guidance commands necessary to guide the missile to the center of the beam or maintain a predetermined distance from a beam's axis. Various techniques based on light scattered from laser beams have been used to provide guidance to missile during flight.

One technique using an operator to guide missiles during flight is described in U.S. Pat. No. 4,234,141 by Walter E. Miller, Jr. which was issued on 18 Nov. 1980. In this guidance system, an observer establishes and maintains a visual line-of-sight contact with a target through a telescope. In tracking the missile's trajectory towards the target, short pulses of collimated light are transmitted from the launch site towards the missile, which pulses are received by an optical receiver on the missile and are simultaneously reflected by a retro reflective prism on the missile. The reflected pulses follow a path parallel to the incident wave and are thus directed back to the launch site. A missile tracker at the launch site responds to the reflected pulses and measures any deviation of the missile from the visual line-of-site axis maintained between the launch site and the target. Guidance commands are then transmitted towards the missile for maintaining the missile on the proper trajectory, which pulses contain correctional signals for the missile's guidance system. The guidance precision of this technique is proportional to the observer's (operator's) skill in maintaining the visual line-of-sight contact with the target and this can be rather variable.

Another missile guidance system is a scatterider guidance system that utilizes a designating beam of laser pulses from the launch pad towards the target. Atmospheric particles scatter the laser pulses and sensors on the missile detect the laser light scattered by the atmospheric particles and onboard guidance electronics calculate the radial distance between the laser beam and the longitudinal axis of the missile. That distance is then used to generate deflection commands for the aerodynamic control surfaces of the missile such that it approaches and stays close to the laser beam. In the embodiment described by McCowan et al in U.S. Pat. No. 6,138,944, laser light scattered from atmospheric particles for one laser pulse is detected by eight aft-looking optical sensors mounted around the circumference of the missile and one annular forward-looking sensor mounted on the nose section. The aft-looking sensors are mounted with their centrelines angled such that they point 60 degrees aft of the perpendicular to the missiles' longitudinal axis and each has a field-of-view of 45 degrees so the eight sensors provide a 360 degree coverage around the missile. The detection of back-scatter laser light is provided by one annular forward-looking sensor that is mounted such that it stares at a 45 degree angle forward of the perpendicular to the missile's longitudinal axis.

In U.S. Pat. No. 6,138,944, when light scattered from a single laser pulse is detected by one of the eight aft-looking sensor and by the forward-looking sensor, this detection as well as the time lapse between the detection by the aft-looking sensor and detection by the forward-looking sensor are provided as inputs to guidance electronics. That time lapse will be directly dependent on the radial distance between the missile's longitudinal axis and the laser beam due to the time it takes the laser beam to travel from the aft-looking detection point and the forward-looking detection point. The guidance electronics is coupled to the aft-looking sensors to derive which one actually detected the scattered light and then calculates the radial distance between the laser beam and the missile using principles of geometry and trigonometry. That distance as well as the aft-looking detector that detected the scattered laser light is used to generate commands for the guidance system to maintain the missile on the desired trajectory with respect to the laser beam. The precision of this guidance system is dependent on the precision of the geometric and trigonometry calculations. The annular forward-looking sensor will limit what type of countermeasure may be effective since no sensor is looking directly at the target. It does, however, require inertial rate sensors and a roll sensor.

Another laser guidance system for a missile is described in JP Patent No. 2000039296 (Application No. JP 98209942) based on three laser beams directed along vertices of an equilateral triangle between which a missile flies and then determines its position by the relative level of laser scattered signal detected by a number of sensors on the missile.

A further laser guidance system for a missile is described by Walter E. Miller, Jr., in US Statutory Invention Registration H299 that was published on 7 Jul. 1987. In this system the operator maintains sight of a target through optics at a fire control station. A laser transmitter on the missile directs a laser beam towards the fire control station where it is received and coupled to a phase conjugated amplifier and redirected back through a spatial encoder to the missile. The encoding provides guidance instructions for the missile where the redirected beam is received and applied to the missile's guidance control system. This guidance system does not have any sensor directed toward the target and this limits what type of countermeasures may be effective. It does, however, require an operator in the loop that has to maintain visual sight of the target.

The majority of guidance techniques, other than those taught by McCowan et al and Walter E. Miller, Jr., share a common weakness in that they are susceptible to detection by the target which can employ countermeasure since the field-of-view of their guidance sensor have to continuously look at the target. Countermeasure that may be employed including dazzling or destruction of the sensor which would ruin the precision guidance of the missile. The majority of these missiles still rely on complex and costly gyroscopes and accelerometers to assist in guidance.

A new generation of hypervelocity missiles presently being developed inevitably call for a highly profiled fuselage nose that denies any possibility of using a forward-looking sensor because that would require a dome at the tip of the missile. There is, as a result, a requirement for a new guidance system for missiles that would be almost immune to known countermeasures while permitting use of a highly profiled nose and provide for a low cost implementation.

SUMMARY OF THE INVENTION

It is an object of the present invention to provide a guidance system for a vehicle which can be independent of inertial motion sensors in the vehicle and less costly to implement.

A guidance system for a vehicle, according to one embodiment of the present invention, comprises a laser source located at a distance from the vehicle, the source having means to generate at least one laser beam, that is directed towards said vehicle with said at least one beam being modulated by a beam encoder, the vehicle having a plurality of backward-looking sensors mounted on its main body to detect radiation scattered from said at least one laser beam by particles in the atmosphere and a plurality of forward-looking sensors located on the vehicle's main body to detect radiation scattered from that laser beam, the sensors having a narrow field-of-view (FOV) in the direction they are directed and a wide FOV in a direction perpendicular to the narrow FOV to provide detection coverage in a pyramid shaped wide area FOV with narrow edges surrounding the vehicle which contains processing electronics to which signals from the sensors are applied, the processing electronics having means to determine a phase shift in signals from the sensors when one sensor in the backward-looking sensors detects light scattered from a laser beam and when a sensor in the forward-looking sensors detect light scattered from that beam, the processing electronics having means to determine the distance between the sensors and a detected laser beam from said phase shift.

BRIEF DESCRIPTION OF THE DRAWINGS

The invention will be described in more detail with reference to the accompanying drawing, in which.

DESCRIPTION OF THE PREFERRED EMBODIMENTS

Precision guidance for missiles has an associated high cost due to the complexity of the guidance techniques used at present. Radar, RF, GPS, TV, IR or lasers are examples of technologies that have been used in missile guidance systems. Many of the present approaches are based on terminal homing seekers but the costs associated with seeker components is high. Other techniques make use of a human in the guidance loop to reduce the complexity, costs and number of components that would, otherwise, be installed aboard a missile. An operator in the loop provides assistance to the missile's guidance system by correcting its trajectory through a data link such that the missile is aimed at the target with the required precision. This approach substantially reduces the cost of a guidance system but the precision becomes directly proportional to the operator's skill and that skill may be highly variable.

Many of the present guidance techniques share a common weakness in that they are susceptible to detection and countermeasures (CM) being applied by a target since the field-of-view (FOV) of their guidance sensor have to continuously look at the target. Moreover, the majority of the guidance systems still rely on very complex and costly gyroscopes and accelerometers to assist in the guidance.

A new generator of hypervelocity missiles presently under development will inevitably call for a highly profiled fuselage nose that denies any possibility of using a forward-looking sensor because that would require a dome at the tip of the missile. These hypervelocity missiles will, as a result, require a different type of guidance system.

Figure 1:
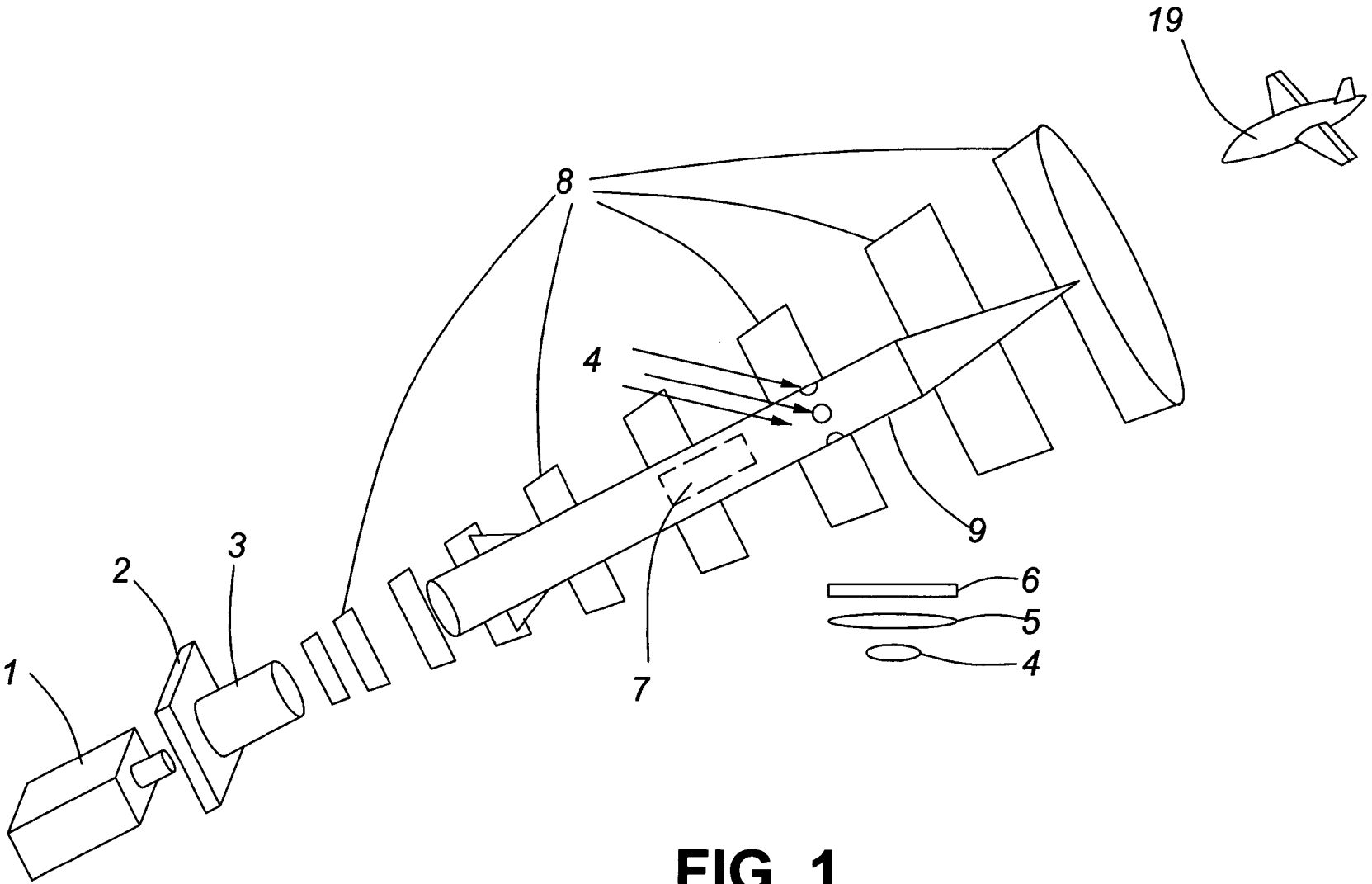
FIG. 1 illustrated a laser beam guidance system for a missile according to a basic arrangement of the present invention.

A basic concept of a missile guidance system according to the present invention is illustrated in FIG. 1. This Missile Steering using Laser SCattering by ATmosphere (MSLSCAT) consists of a laser source 1 directing laser beam pulses 8 towards a missile 9, a laser beam encoder 2 modulating the beam and zoom optics 3. A series of lasers sensors 4 each fitted with a lens 5 and an optical filter 6 are located on and around an outside surface of missile 9, these being connected to processing electronics 7 in the missile 9.

The laser source 1, beam encoder 2 and zoom optics 3 that form part of a guidance source are located at a missile launcher site while the sensors 4, lenses 5, filters 6 and electronics 7 represent guidance sensor devices and processing electronics that are mounted aboard the missile 9. The beam from laser source 1 is modulated, temporally and/or spatially, by the beam encoder 2 and is used to bear information that will be used by missile for its guidance. Guidance schemes are numerous and may include either temporal modulation such as sinusoidal or square-wave waveforms or a complex series of pulses, or spatial modulation such as annular or multi-element beams. Combinations of various schemes may also be used. In one simple embodiment, the beam will be simultaneously square-wave modulated and spatially encoded to bear an annular shape as illustrated by designations 8 in FIGS. 1 and 2.

The modulated beam 8 is projected towards a target 19 after passing through the zoom optics 3 as illustrated in FIG. 1. The zoom optics 3 varies the size of the annular beam in order to ensure that the missile 9 is engulfed in the beam when the missile 9 is launched or shortly thereafter. The divergence of the annular beam is progressively reduced as the missile 9 approaches the target 19 to maintain a high degree of precision in the guidance of the missile. Prior to or simultaneously with the launching of missile 9, the laser source is switched on and the missile will be fired into a central portion of the annular beam 8 and fly within it up to the target.

Figure 2:
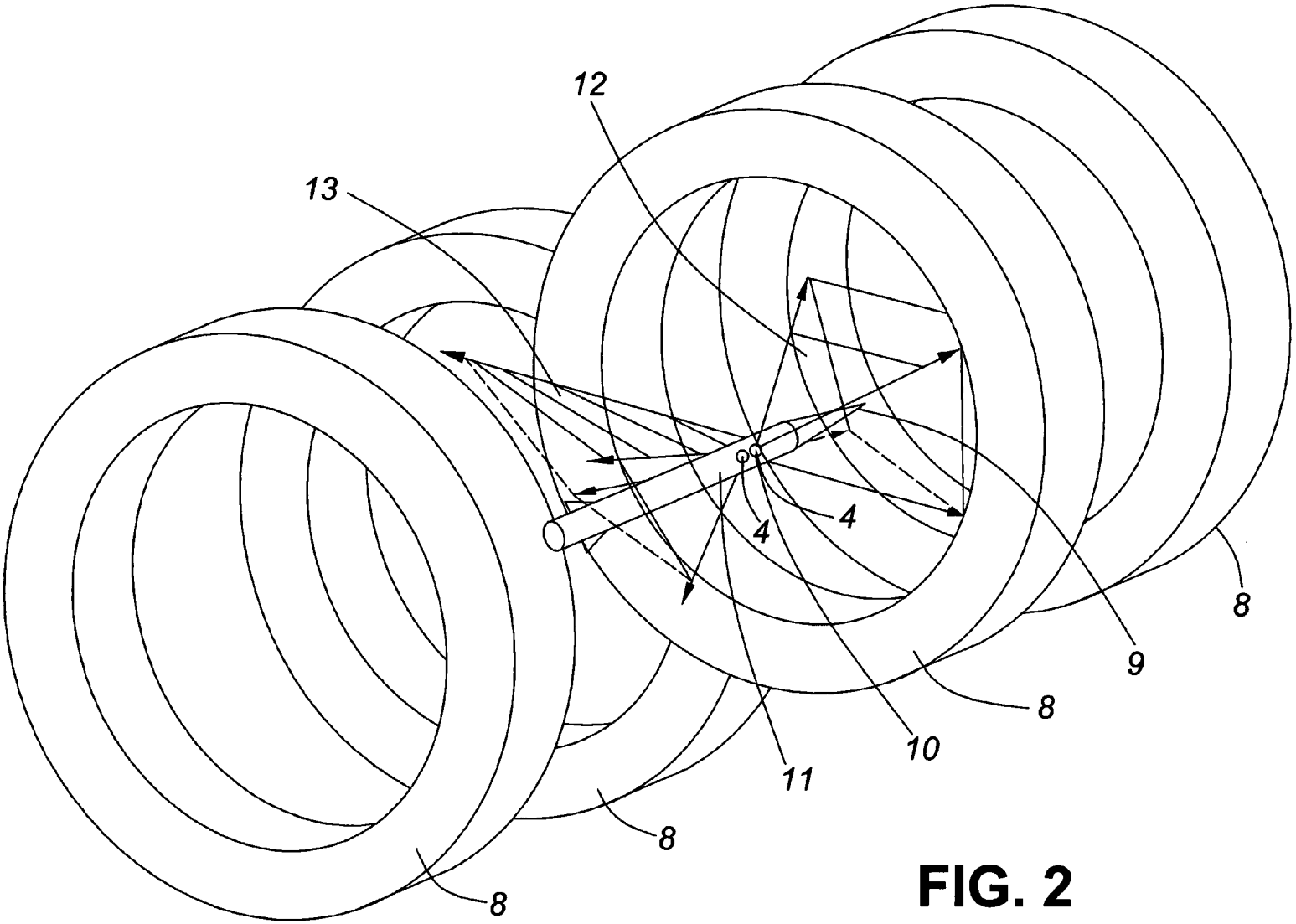
FIG. 2 illustrates a laser beam guidance system for a missile according to one embodiment of the present invention and the field-of-view of sensors located on the missile.
Figure 3:
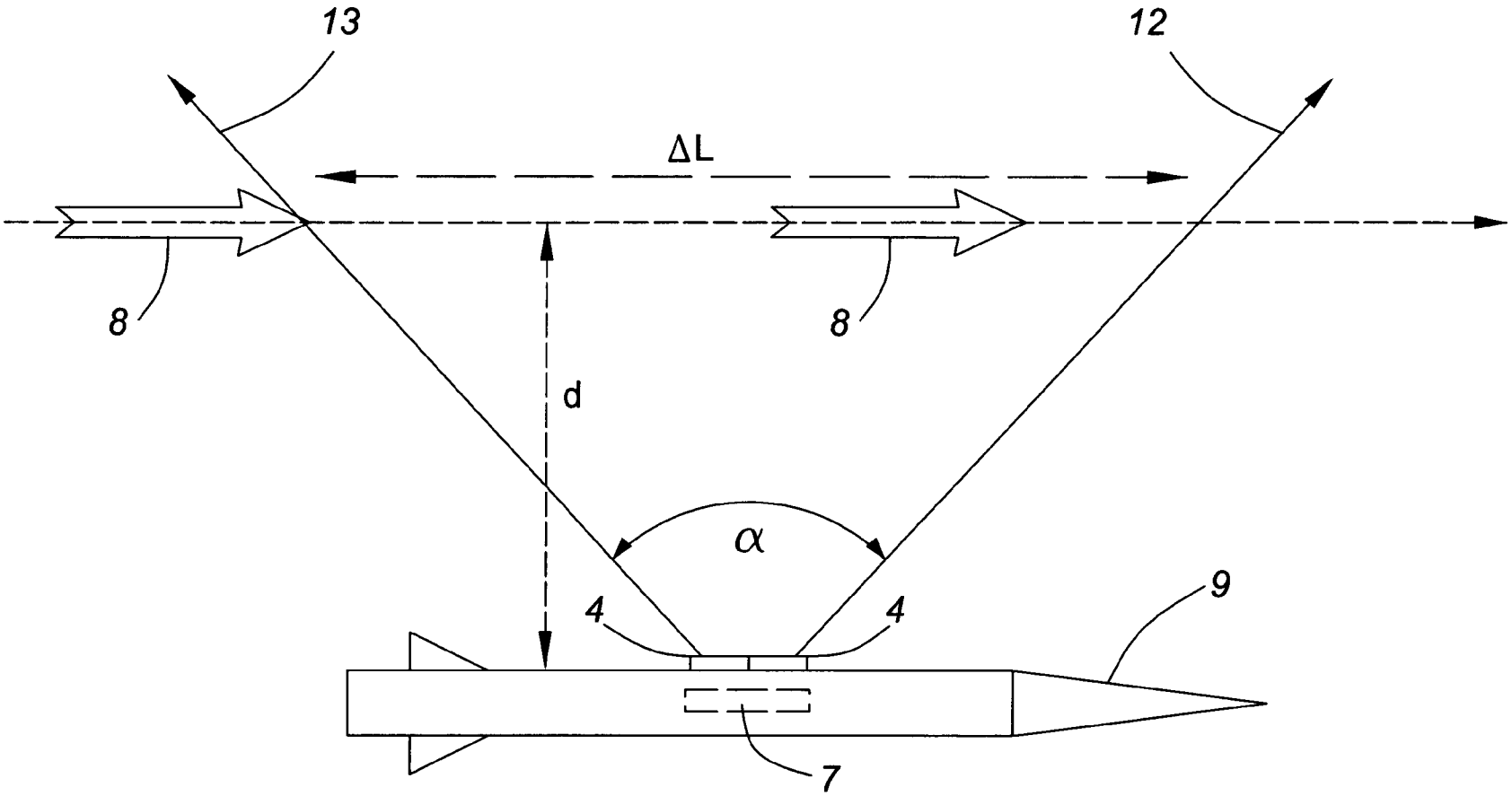
FIG. 3 shows the relationship between the field-of-view of sensors located on a missile and a laser beam according to the one embodiment of the present invention illustrated in FIG. 2.

The missile uses its laser sensors 4 during the flight to detect laser light from a laser beam 8 scattered by particles and molecules naturally present in the atmosphere. The sensors 4 mounted around the circumference of the missile 9 are grouped into two banks of four as illustrated in FIG. 2, one bank 10 looking forward and the other bank 11 looking backward. Each sensor 4 contains an optical filter 6 (see FIG. 1) to reduce the background light level and a lens 5 that defines a field-of-view (FOV), 90 degrees, for example, in one axis as illustrated at 12 and 13 in FIG. 2 and a very narrow FOV in the other axis that is perpendicular to the planes 12 and 13. Four planes are formed by the narrow FOV for each bank, each plane having a 90 degree FOV to provide a 360 degree annular (square) pyramid shaped FOV 12 for the forward-looking group of sensors 10 and a 360 degrees annular (square) pyramid shaped FOV 13 for the backward-looking group of sensors 11. More than four sensors may be used in each bank of sensors, each sensors with a wide FOV of less than 90 degrees. The FOV formed by the two groups are separated by a relatively large angle $\alpha$ as illustrated in FIG. 3. A laser beam 8, when switched ON, will first reach and be detected by sensors associated with the backward-looking FOV 13 and then, after a small delay, cross the FOV 12 of sensors associated with the forward-looking sensors. This results in, assuming the beam 8 has a square-wave modulation, in the forward-looking sensors generating a square-wave signal slightly out of phase with the square-wave signal generated by the backward-looking sensors for the same laser pulse. This phase shift is produced by the short time required by the laser light to travel from the backward-looking FOV 13 to the forward-looking FOV 12. The laser beam 8 travels one meter in 3.3 ns and the distance $\Delta L$ (see FIG. 3) the beam travels from its point of intersection with the backward-looking FOV 13 and its point of intersection with the forward-looking FOV 12 determines the amount of phase shift of the signals generated by the backward-looking sensors and forward-looking sensors. That distance $\Delta L$ is also dependent on the radial distance d between the missile and the beam path, i.e. the further the beam's path is from the missile 9, the larger the distance $\Delta L$ will be as illustrated in FIG. 3. If the angle $\alpha$ between the two FOV is, for instance 90 degrees, the distance $\Delta L$ can be determined from the formula $$\Delta L = 2dTg(\alpha/2) \tag{1}$$

and then the radial distance d between the missile and the beampath will be $$d = \frac{\Delta L}{2Tg(\alpha/2)} \tag{2}$$

The outputs of the backward and forward-looking sensors are fed into processing electronics 7 in the missile to determine the axial distance d to the beam from the sensors 4. The beam 8 surrounds the missile 9 as a number of annular pulses 8 (see FIG. 2). Therefore, the processing electronics 7 can accurately determine any missile deviation from the center of the annular beam 8. Lock-in type of electronics can be used to very precisely determine the phase difference between the detected signals and, as a result, the axial distance d.

Since a set of four sensors 4 are used in both the backward and forward looking group of sensors, the outputs of two corresponding sensors (one looking forward and the other looking backward) are used for azimuth and elevation guidance signals. Two pairs of sensors are used for azimuth trajectory corrections whereas the other two are for elevation correction. Two sensor pairs are used for each axis to provide some redundancy in the measurement of the axial distance d so that when the missile is very near or even touches the edge of the beam, the other sensor will still be capable of generating a correction signal. The status (azimuth or elevation) of the data provided by the sensor pairs depends on their roll angle position, i.e. if the missile rolls at the time of measurement. If the missile rolls at the time of measurement, that roll can be estimated from the modulation of the sensor's output.

Figures 4A, 4B:
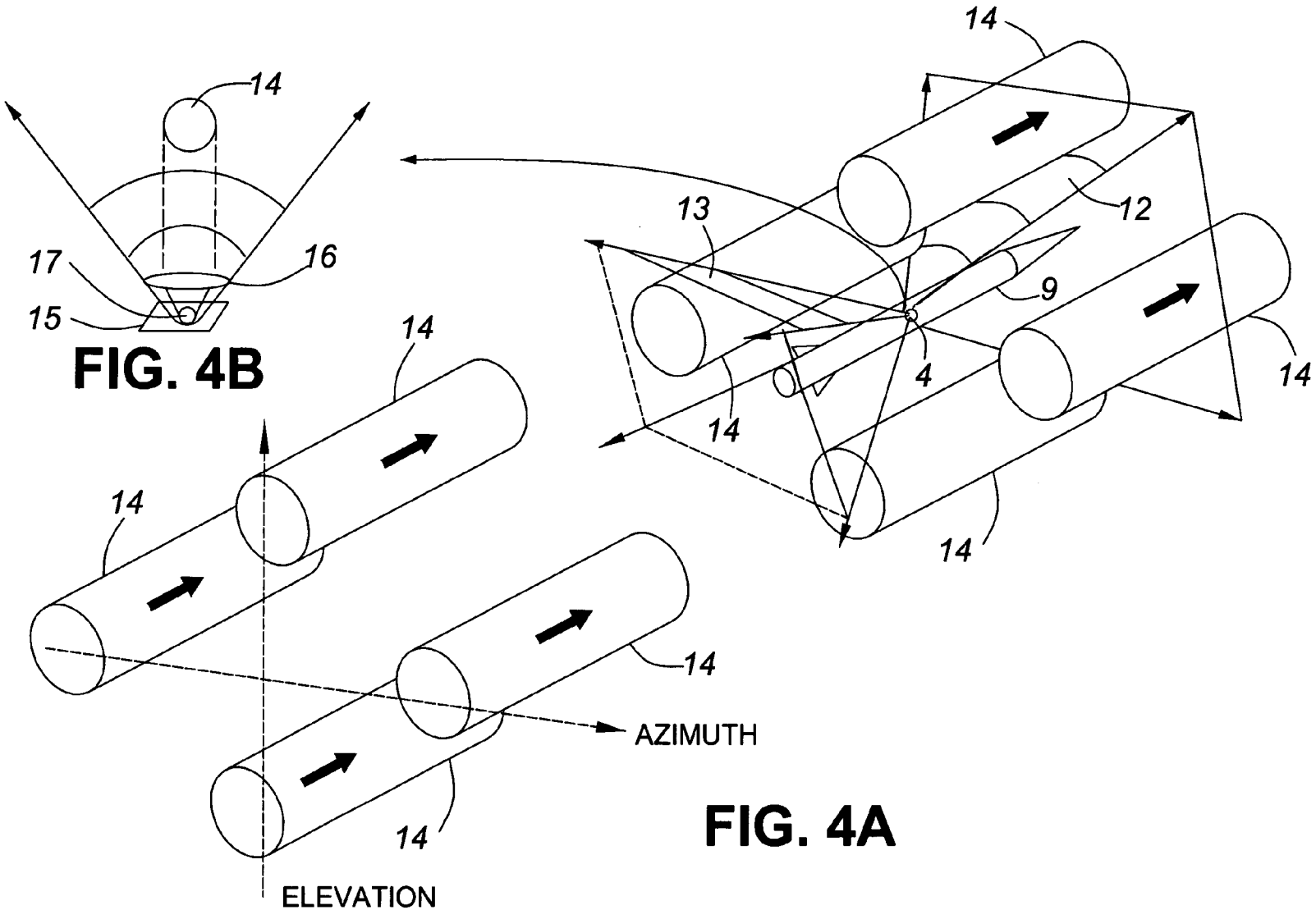
FIG. 4A illustrates a laser beam guidance system for a missile according to another embodiment of the present invention and FIG. 4B illustrates the operation of a position sensor in the system shown in FIG. 4A.

A MSLSCAT guidance system according to another embodiment of the present invention is illustrated in FIG. 4A. In this system, the generated laser beam is spatially shaped to generate four-individual beams 14 angularly spaced apart by 90 degrees. Each beam 14 is temporally modulated in a different way, i.e. frequency or pulse shape. The advantage of having differently modulated beams is that the missile's processing electronics can estimate its roll angle from the modulation that particular sensor pairs detect. One or more forward-looking or backward-looking laser beam sensors 4 on the missile may be replaced by a position sensor 15, a sensor 15 with a flat surface onto which a lens 16 focuses an image 17 of the laser beam 14 (see FIG. 4B). The position sensor 15 is able to accurately determine (within a fraction of a degree) the angular position of the laser beam in its FOV from the position of the imaged laser beam 17 on the position sensor 15. The lens 16 generates an image of the laser beam 14 (from scattered light) onto the flat detector surface of the position sensor 15 and that position is directly related to the angular position of the laser beam 14 as illustrated in FIG. 4B. This allows the missile's guidance system to operate without a roll sensor which is an expensive and somewhat fragile missile component.

Figure 5:
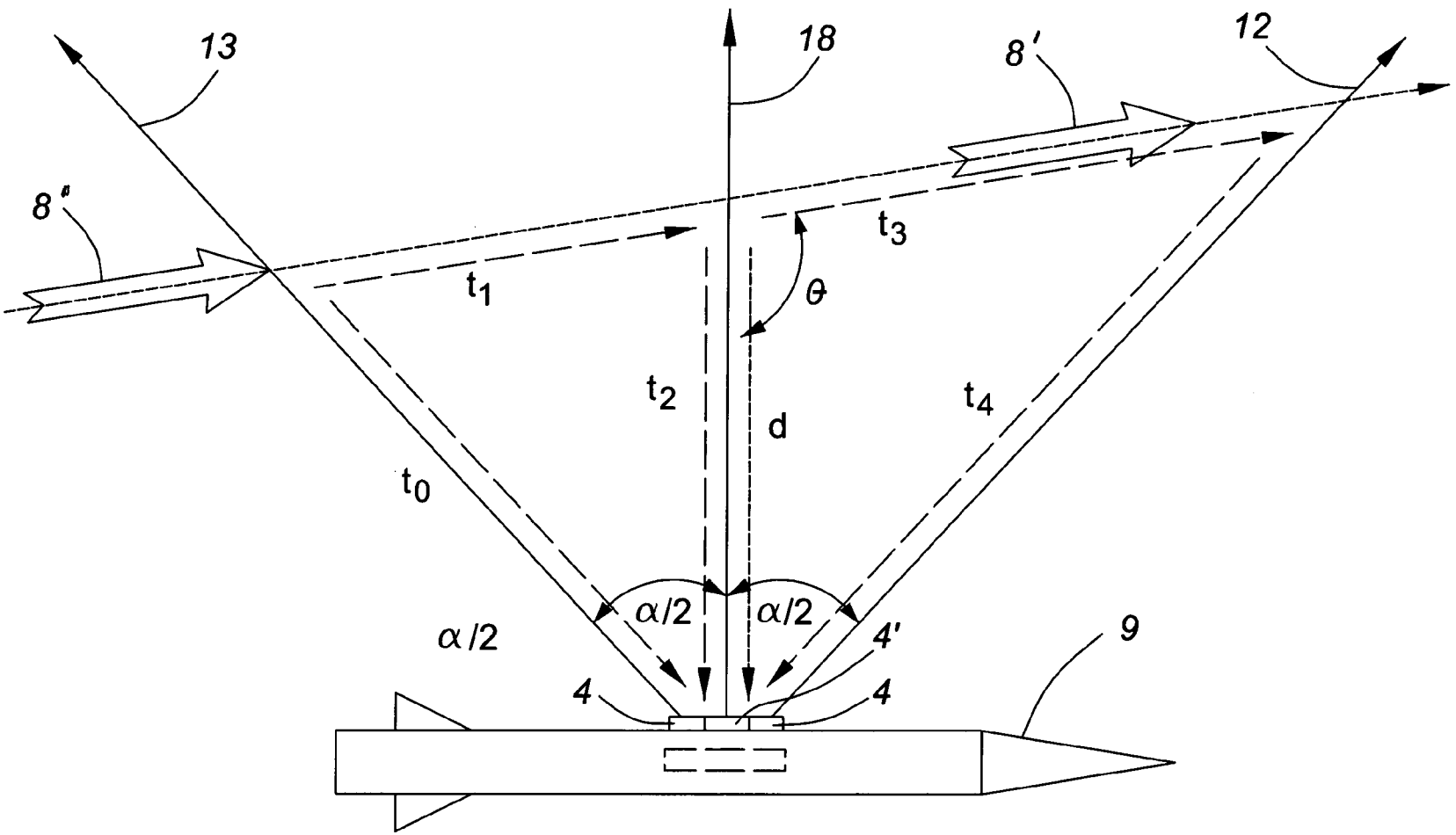
FIG. 5 illustrates a laser beam guidance system for a missile according to a further embodiment of the present invention.

Another embodiment of a MSLSCAT guidance system according to the present invention is illustrated in FIG. 5. Two groups of sensors 4 are provided on and around the main body of the missile 9 to provide a backward-looking FOV 13 and a forward-looking FOV 12 as in the previously described embodiments. Another group of sensors 4' are provided, in this embodiment, that has a center-looking FOV 18 which is perpendicular to the missile's longitudinal axis. This additional group is located between the forward and backward-looking groups.

The additional group of sensors 4' allows the processing electronics 7 to not only determine the position of the missile relative to a laser beam 8' but to also determine the azimuth and elevation angles of the missile. The pitch and yaw missile attitude sensors normally used in a missile's guidance system can, as a result, be eliminated with a substantial cost reduction in the guidance system.

The determination of the missile's 9 azimuth and elevation angles with respect to the laser beam 8' direction of travel is possible due to the two phase shift measurements: Δ1' between when the backward-looking FOV sensors detect the laser beam 8' and when the center-looking FOV sensors 4' detect the laser beam 8' and Δ2 between when the center sensors 4' detect the beam 8' and the forward-looking FOV sensors detect the beam. The azimuth and elevation angles are functions of such a phase ratio. In FIG. 5, for instance, the azimuth angle θ is a function of the ratio of $\Delta_1$ and $\Delta_2$:

$$\theta \text{ is a function of } \frac{\Delta_1}{\Delta_2} = \frac{t_1 + t_2 - t_0}{t_3 + t_4 - t_2}$$

A similar expression is used to determine the elevation angle.

Various modifications may be made to the preferred embodiments with departing from the spirit and scope of the invention as defined in the appended claims. The guidance system described in the preferred embodiments is one used to guide missiles but other applications exist such as where other types of vehicles have to be precisely and remotely guided.

The invention claimed is:

1. A guidance system for a vehicle comprising a laser source located at a distance from the vehicle, the source having means to generate at least one laser beam that is directed towards the vehicle with said at least one laser beam being modulated by a beam encoder, the vehicle having a plurality of backward-looking sensors mounted on its main body to detect radiation scattered from said at least one laser beam by particles in the atmosphere and a plurality of forward-looking sensors located on the vehicle's main body to detect radiation scattered from that laser beam, the backward-looking sensors and forward-looking sensors having a first field-of-view (FOV) in the direction they are directed along the missile's longitudinal axis and a second, wider FOV in a direction perpendicular to the first FOV to provide detection coverage in a pyramid shaped FOV with edges surrounding the vehicle which contains processing electronics to which signals from the sensors are applied, the processing electronics having means to determine a phase difference between the forward-looking and backward-looking sensors and means to determine a distance between the sensors and that laser beam from said phase difference.

2. A guidance system for a vehicle as defined in claim 1, wherein the sensors first FOVs of the sensors are at an angle to the vehicle's direction of motion.

3. A guidance system for a vehicle as defined in claim 1, wherein the beam encoder modulates the laser beam with a square wave to provide a pulsed beam.

4. A guidance system for a vehicle as defined in claim 3, wherein the backward-looking sensors first FOV and the forward-looking sensors first FOV are separated by an angle of about 90 degree.

5. A guidance system as defined in claim 1, wherein lock-in type of electronics in the processing electronics is used to very precisely determine phase difference of signals from the sensors.

6. A guidance system as defined in claim 1, wherein the beam encode modulates the laser beam with a square wave to provide a pulsed beam.

7. A guidance system for a missile comprising a laser source located at a launch pad, the source having means to generate at least one laser beam that can be directed towards a target, the said at least beam being modulated by a beam encoder and directed through zoom optics to alter the divergence of the beam during the missile's flight, the missile having a plurality of backward-looking sensors located on and spaced around a circumference of its main body to detect radiation scattered from said at least one laser beam and a plurality of forward-looking sensors located on and around a circumference of the missile's main body, the sensors having a first field-of-view (FOV) in a direction perpendicular to the missile's longitudinal axis and a second, wider FOV in a direction perpendicular to the first FOV forming an angular shaped FOV with an apex at the longitudinal axis, the first FOVs being arranged in the form of a polygon with flat sides surrounding the missile which contains processing electronics to which signals from the sensors are applied, the processing electronics having means to determine a phase difference between forward-looking and backward-looking sensors and means to determine the distance between the sensors and that laser beam from said phase difference.

8. A guidance system for a missile as defined in claim 7, wherein four sensors in each forward and background-looking group of sensors form an FOV with a pyramid shape having an apex at said longitudinal axis, each wider FOV covering at least 90 degrees.

9. A guidance system as defined in claim 7, wherein the sensors first FOVs are at an angle to the vehicle's direction of motion.

10. A guidance system as defined in claim 9, wherein the backward-looking sensors first FOV and the forward looking sensors first FOV are separated by an angle of about 90 degrees.

11. A guidance system as defined in claim 7, wherein the beam encoder modulates the laser beam with a square wave to provide a pulsed beam.

12. A guidance system as defined in claim 7, wherein an additional group of sensors is located between the backward-looking sensors and the forward-looking sensors, the additional group of sensors having a center-looking FOV which is perpendicular to the missile's longitudinal axis the processing electronics having means to determine the azimuth and elevation angles of the missile from a phase shift measurement from when the backward-looking sensors detect said at least one laser beam and when the additional sensors detect that beam and a phase shift measurement from when the additional group of sensors detect that beam and when the forward-looking sensors detect that beam.

13. A guidance system as defined in claim 7, wherein the laser source generates four laser beams angularly spaced apart by 90 degrees and a position sensor is included having a lens to focus radiation scattered from one of the beams onto a flat detector surface and provide a signal to the processing electronics, the position on the detector at which an image of light scattered from a laser beam is located being directly related to the angular position of that beam.

14. A guidance system as defined in claim 7, herein lock-in type of electronics in the processing electronics is used to very precisely determine phase difference of signals from the sensors.

* * * * *